US011555366B2

(12) United States Patent
Skjeie et al.

(10) Patent No.: US 11,555,366 B2
(45) Date of Patent: Jan. 17, 2023

(54) DRILL PIPE STRING CONVEYED RETRIEVABLE PLUG SYSTEM

(71) Applicant: Archer Oiltools AS, Stavanger (NO)

(72) Inventors: Trond Skjeie, Hundvag (NO); Andreas Fliss, Stavanger (NO)

(73) Assignee: ARCHER OIL TOOLS AS, Stavanger (NO)

( * ) Notice: Subject to any disclaimer, the term of this patent is extended or adjusted under 35 U.S.C. 154(b) by 7 days.

(21) Appl. No.: 17/084,331

(22) Filed: Oct. 29, 2020

(65) Prior Publication Data

US 2021/0254420 A1 Aug. 19, 2021

(30) Foreign Application Priority Data

Oct. 29, 2019 (NO) ..... 20191294

(51) Int. Cl.
*E21B 23/06* (2006.01)
*E21B 33/134* (2006.01)
(Continued)

(52) U.S. Cl.
CPC ..... *E21B 23/06* (2013.01); *E21B 23/006* (2013.01); *E21B 33/134* (2013.01);
(Continued)

(58) Field of Classification Search
CPC ..... E21B 23/06; E21B 23/006; E21B 47/07; E21B 47/007; E21B 33/134; E21B 34/066
See application file for complete search history.

(56) References Cited

U.S. PATENT DOCUMENTS 2,842,212 A 7/1958 Lebourg et al.
3,027,943 A * 4/1962 Reistle, Jr. ..... E21B 33/138 166/305.1
(Continued)

FOREIGN PATENT DOCUMENTS

EP 2 245 260 B1 9/2013
GB 2 275 951 A 9/1994

OTHER PUBLICATIONS

Great Britain Combined Search and Examination Report under Sections 17 and 18(3) for Great Britain Application No. GB2017186.4, dated Jul. 7, 2021.
(Continued)

*Primary Examiner* — D. Andrews
(74) *Attorney, Agent, or Firm* — Birch, Stewart, Kolasch & Birch, LLP

(57) ABSTRACT

A drill pipe string conveyed retrievable plug system has a central through bore. The plug system includes a drill pipe string; a control section; a running tool with a connector at a lower end of a drill pipe string with the control section, and a top connector on a mechanical plug section with a bridge plug. The mechanical plug section includes a mandrel with the through bore, a ball valve arranged for closing the through bore, and a packer sleeve on the mandrel with slips and a packer element. The control section includes an electric supply, an electric control unit, and sensors connected to the electric control unit. The mechanical plug section includes a motor controlled by the electrical control unit. The motor is arranged to turn a selector ring to a selected first rotational position so as for allowing a piston sleeve to slide to an axial first stop position in order for opening to fluid channels through the mandrel from the through bore to the packer sleeve. The pressure in the
(Continued)

through bore can be set to the pressure of the packer sleeve in a surrounding casing.

22 Claims, 5 Drawing Sheets

(51) Int. Cl.

| | |
|---|---|
| ***E21B 23/00*** | (2006.01) |
| ***E21B 34/06*** | (2006.01) |
| *E21B 47/007* | (2012.01) |
| *E21B 47/07* | (2012.01) |

(52) U.S. Cl.
CPC ..... *E21B 34/066* (2013.01); *E21B 47/007* (2020.05); *E21B 47/07* (2020.05)

(56) References Cited

U.S. PATENT DOCUMENTS

| | | | | |
|---|---|---|---|---|
| 4,427,063 | A * | 1/1984 | Skinner | E21B 23/006 166/134 |
| 5,893,413 | A | 4/1999 | Lembcke et al. | |
| 7,086,481 | B2 | 8/2006 | Hosie et al. | |
| 7,703,525 | B2 * | 4/2010 | Wilcox | E21B 43/26 166/305.1 |
| 2010/0307773 | A1 | 12/2010 | Tinnen et al. | |
| 2018/0202269 | A1 | 7/2018 | Wensrich et al. | |

OTHER PUBLICATIONS

Norweigan Search Report for Norweigan Application No. 20191294, dated May 28, 2020, with an English translation.

* cited by examiner

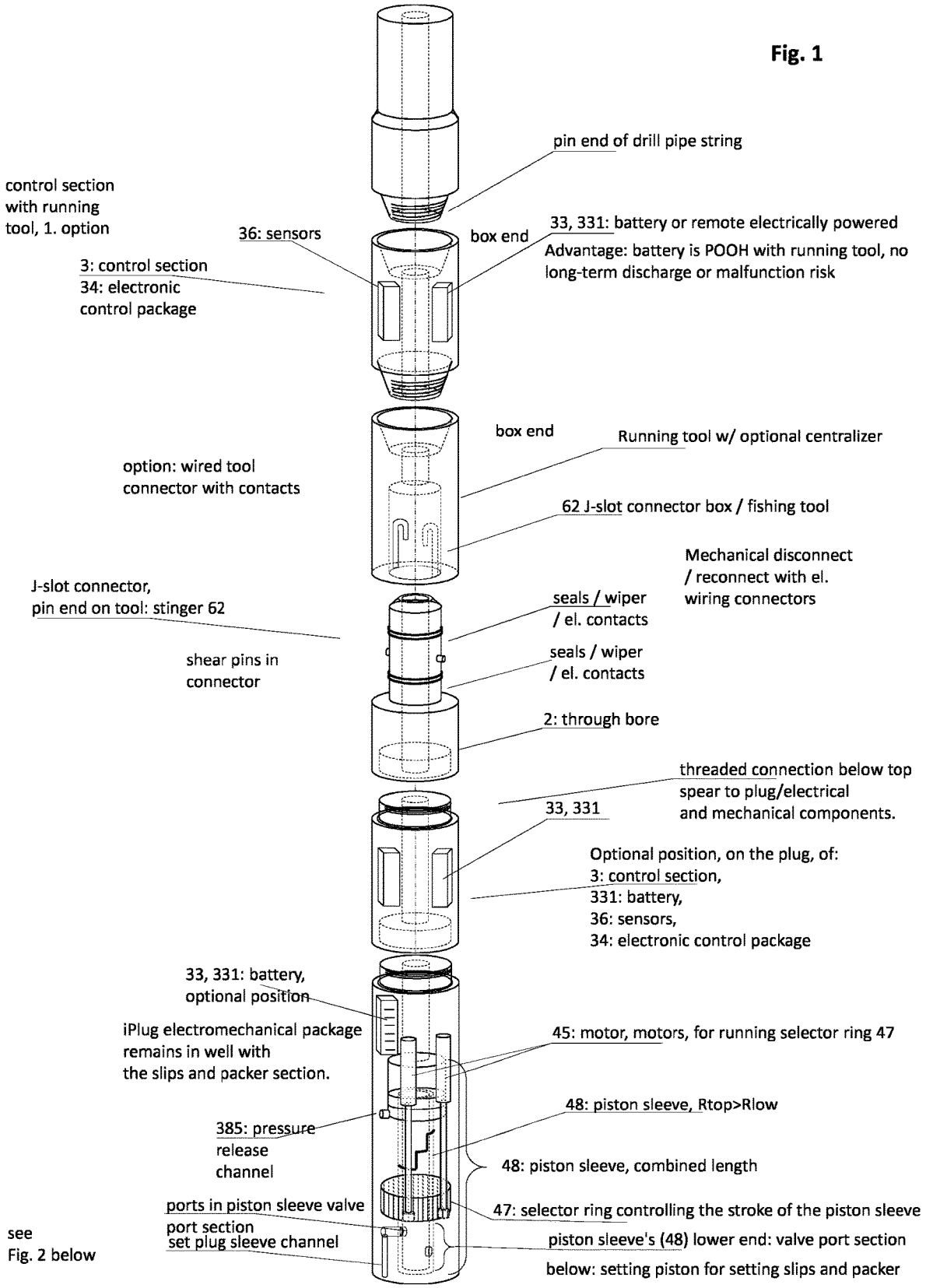
Fig. 1
pin end of drill pipe string
control section
with running
tool, 1. option
36: sensors
box end
33, 331: battery or remote electrically powered
Advantage: battery is POOH with running tool, no
long-term discharge or malfunction risk
3: control section
34: electronic
control package
box end
Running tool w/ optional centralizer
option: wired tool
connector with contacts
62 J-slot connector box / fishing tool
Mechanical disconnect
/ reconnect with el.
wiring connectors
J-slot connector,
pin end on tool: stinger 62
seals / wiper
/ el. contacts
shear pins in
connector
seals / wiper
/ el. contacts
2: through bore
threaded connection below top
spear to plug/electrical
and mechanical components.
33, 331
Optional position, on the plug, of:
3: control section,
331: battery,
36: sensors,
34: electronic control package
33, 331: battery,
optional position
iPlug electromechanical package
remains in well with
the slips and packer section.
45: motor, motors, for running selector ring 47
48: piston sleeve, Rtop>Rlow
385: pressure
release
channel
48: piston sleeve, combined length
ports in piston sleeve valve
port section
set plug sleeve channel
47: selector ring controlling the stroke of the piston sleeve
piston sleeve's (48) lower end: valve port section
below: setting piston for setting slips and packer
see
Fig. 2 below 2 (main bore) also through piston sleeve 48
el. power line to motor 45
48: piston sleeve
485 return spring
484 pressure release channel to annulus
protrusions with stop positions giving selected stop positions for stroke lengths
PR3
PR3
PR2
47: selector ring with 1., 2., 3., rot. positions PR1, PR2, PR3, .....
PR1
PR0
45: motor
to valve sleeve
port sleeve section
hydraulic ports from central bore

DRILL PIPE STRING CONVEYED RETRIEVABLE PLUG SYSTEM

CROSS REFERENCE TO RELATED APPLICATIONS

This non-provisional application claims the benefit under 35 U.S.C. § 119(a) to Patent Application No. 20191294, filed in Norway on Oct. 29, 2019, which is hereby expressly incorporated by reference into the present application.

FIELD OF THE INVENTION

The present invention relates to a downhole electronically activated bridge plug (1) with through bore (2), the bridge plug conveyed on a drill pipe string.

More specifically, the bridge plug (1) of the invention is enabled to be controlled via a predefined drill pipe string rotation speed detected by an electronic control unit's sensors, and drill pipe string pressure, to select one or more of setting slips in a casing and setting a packer to seal the annulus, closing a ball valve, and releasing the drill pipe string (and a running tool) from the set bridge plug. The bridge plug may then remain set in the well for as long as the operation (or pause of operation) requires, such as temporary plugging for conducting operations above the plug, or temporarily plugging and leaving a lower part of a drill string below the plug in the well at the end of a drilling season until drilling is resumed next season, or for the duration of replacing a valve or casing or well component further downstream above the bridge plug.

Moreover, the bridge plug is enabled to be reconnected by a drill pipe string running tool, signalling to the electronic control to conducting one or more of the following operations using pressure: opening the ball valve to test or bleed off pressure below plug in a controlled manner, (possibly for closing the ball valve), releasing the packer, and releasing the slips.

BACKGROUND OF THE INVENTION

Bridge plugs are commonly used in wellbores to isolate a part of the wellbore. Often a plug is set in a casing to act as a barrier against formation pressure. Plugs are often set on a drillpipe string by applying weight, torque or pressure or a combinations of said forces. By rotating the drillstring, torque can be transferred to the setting mechanism in the plug which is usually provided with drag blocks arranged for creating a counter-torque to allow unscrewing and releasing temporary ratchet locks, and by setting down weight on the drillpipe string, the weight of the drillpipe string can set slips which further allows to set the packer. By landing a ball or some sort of obturator in a landing seat and thereafter applying pressure to the inside of the drillpipe string to activate the setting mechanism.

When a background art plug is to be set at great depths in a well it may be difficult to transfer torque and weight via the drill pipe string down to the plug in a controlled manner. The drill pipe string is subject to friction and one may not expect that a given number of rotations topsides will result in the same number of turns at the downhole tool. The drill pipe string also has hysteresis. High deviation in the wellbore also makes it harder to transfer weight to the tool in a controlled manner. Further, an increasing deviation from the vertical may eventually make it difficult and to land a ball in a ball seat. Setting plugs where setting down weight on top of the plug is part of the setting sequence can also be a problem when the plug is to be set at shallow depths, because there might not be enough weight in the drill string to set slips and packer elements.

Thus there is a need for solutions that reduce the complexity of the setting sequence and that reduce the problems related to using mechanical force from the drill string in the setting sequence. Dropping balls to set plugs can also be time consuming as the ball might have to travel for a long distance to reach a ball seat in a plug i.e. increase the use of rig time and thus increasing the cost of the operation.

DISCLOSURE OF THE BACKGROUND ART

The company Intelligent Drilling Tools provides a bypass drilling valve with a selector ring for initiating opening a sleeve for partial mud bypass during drilling.

SUMMARY OF THE INVENTION

The method according to the present invention is given in the attached independent method claims.

A plug according to the present invention is given in the attached independent device claims.

Advantages of the Present Invention

One advantage of the invention is to provide a plug with a reliable setting sequence independent of ball drop and releasing/activating rotation sequences.

Another advantage of the invention is to provide a plug that can be set by applying pressure in combination with sending a control signal.

Yet another advantage of the invention is to provide a plug that eliminates the need for applying torque or weight trough the drillstring for setting the plug.

Yet another advantage of the invention is to provide a method for setting a plug that eliminates the need for applying torque and weight trough the drillstring to set a plug.

DESCRIPTION OF THE DRAWINGS

Embodiments of the present invention will now be described, by way of example only, with reference to the following drawings wherein:

FIG. 1 shows an embodiment of the present invention from the drill pipe string lower end to the top of the packer and slips sleeve of the plug, with alternative position for the control section (3) arranged above or below the running tool.

REFERENCE NUMERALS

Figure 2:
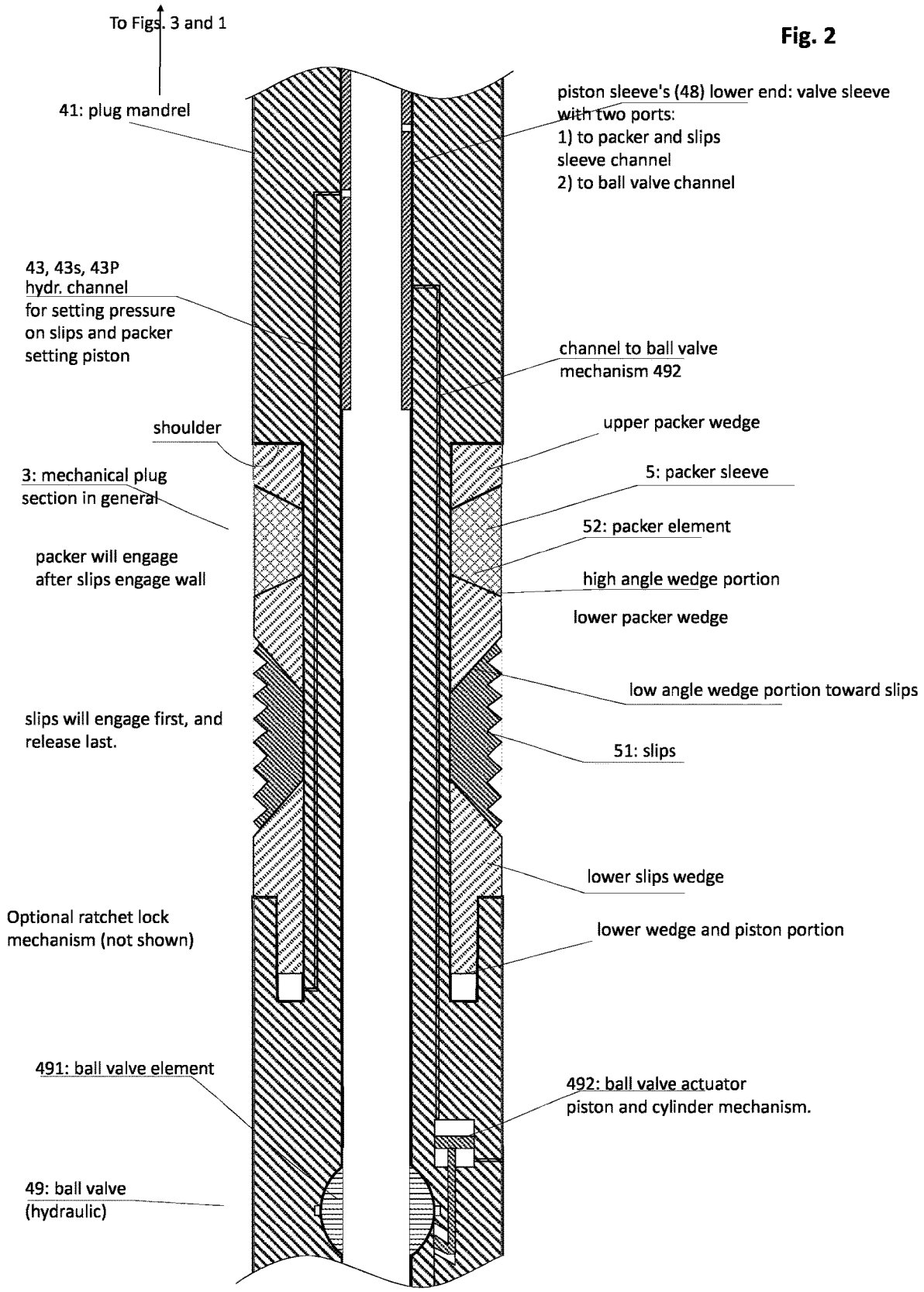
FIG. 2 shows an embodiment of the packer an slips sleeve section of the plug down to a ball valve portion.

1 Bridge plug
2 Through bore

3 Control section
4 Mechanical plug section
41 Mandrel
47 Selector ring
471 Nob
48 Piston sleeve
481 First piston sleeve area (at top)
482 Second piston sleeve area (at lower end)
483 Piston sleeve extension
484 Annulus communication channel from behind piston
485 Biasing member, return spring for the piston sleeve 48
49 Ball valve,
5 Packer sleeve
51 Slips
52 Packer element
43, 43*s*, 43P, 43B Activation channels
6 running tool with connector/disconnector
61 running tool connector (61) with J-slot
62 top stinger (62)
8 Activation sleeve

EMBODIMENTS OF THE INVENTION

The invention is a drill pipe string conveyed retrievable plug system wherein the plug, at least before setting, is provided with a electronic control section which is arranged for detecting a "activate setting" signal from surface, and which upon receipt of such an activate setting signal from surface conducts initiation of the mechanical setting of slips and packer via pressure in the central bore of the drill pipe string and the plug system. An illustration of the invention is made in FIG. 1 and in FIG. 3, while details of the hydraulic set plug of the invention is made in FIG. 2. In an embodiment, the system is also provided with a ball valve in the central bore of the plug in order to allow controlled run-in-hole, closing of the plug when set. In an embodiment the plug system comprises a connector/disconnector on the running tool so as for allowing pull-out-of-hole of the drill pipe string with running tool when the plug is set. In an embodiment the plug is retrievable by the same drill pipe string running tool.

Figure 3:
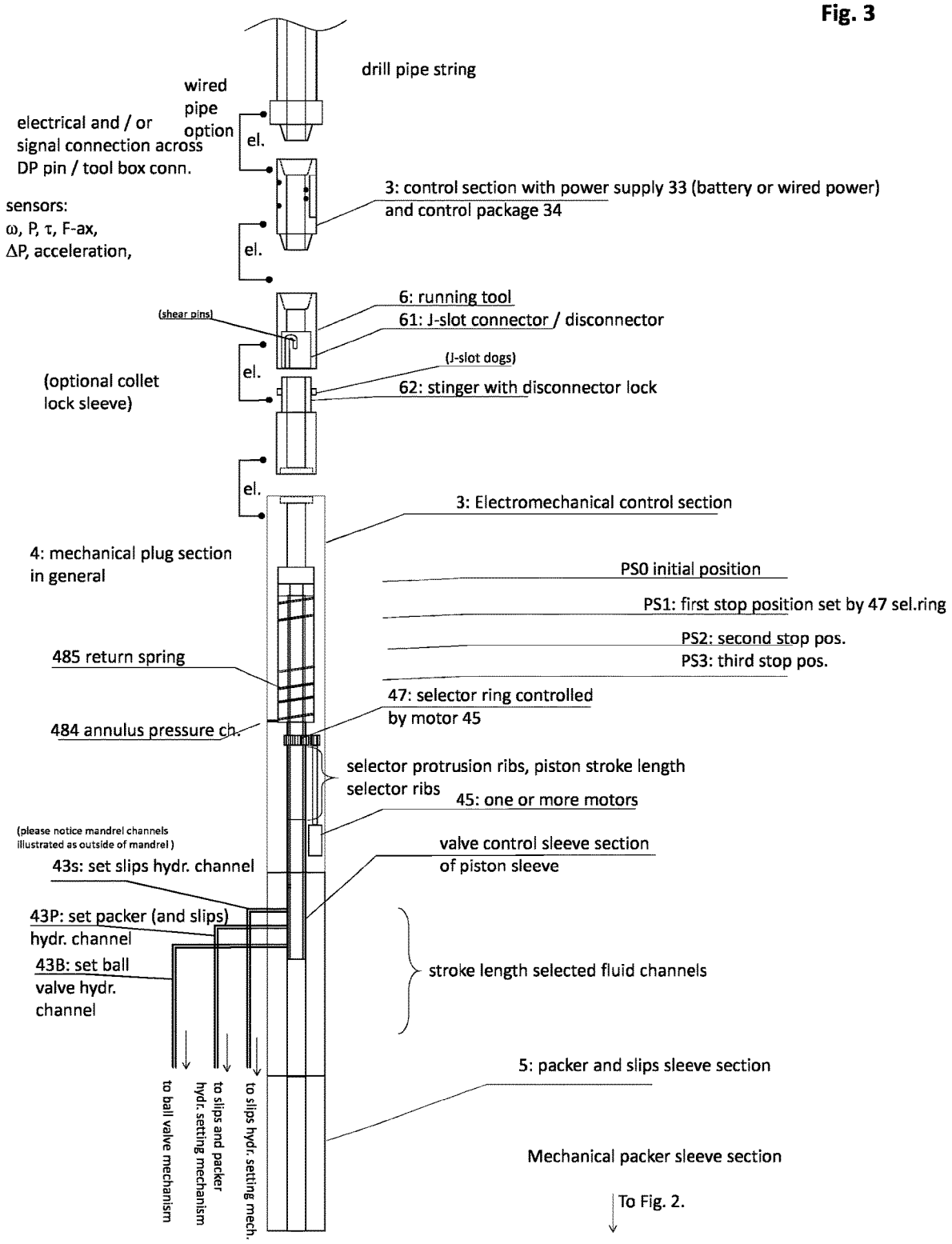
FIG. 3 shows an an embodiment of the present invention from the drill pipe string lower end to the top of the packer and slips sleeve of the plug, wherein the control section (3) is illustrated above the running tool.

More specifically, the invention is a drill pipe string conveyed retrievable plug system having a central through bore (2), wherein said plug system comprises, please see FIGS. 1, 2, and 3:

a drill pipe string extending from surface;

a control section (3) preferably arranged on the drill pipe string and above a running tool (6);

the running tool (6) with a connector (61) at a lower end of said drill pipe string with said control section (3). Further the invention comprises a top stinger (62) on a mechanical plug section (4) with a bridge plug section (1). This top stinger (62) is disconnectable from said connector (61), and remains on the plug when disconnected from the running tool.

The bridge plug section (1) comprises a mandrel (41) with said through bore (2)

a packer sleeve (5) on said mandrel (41) with slips (51) and a packer element (52).

The control section (3) of the invention comprises an electrical supply (33), an electric control unit (34), and sensors (36) connected to said electric control unit (34).

A mechanical plug section (4) of the bridge plug section (1) further comprises a motor (45) controlled by said electrical control unit (34), wherein said motor (45) is arranged for opening from said through bore (2) to fluid channels (43, 43P, 43S) through said mandrel (41) to said packer sleeve (5), so as for allowing setting pressure in said through bore (2) to pressure setting through said fluid channels (43, 43P, 43S) to said packer sleeve (5) to be engaged in a surrounding casing. This concludes the definition of the signal controlled hydraulic settable bridge plug.

In an embodiment of the invention the drill pipe string conveyed retrievable plug system comprises a ball valve (49) arranged for closing said through bore (2). This allows the plug to be closed before disconnection, thus the well is permanently or temporarily closed. The ball valve (49) also allows for testing the pressure below the plug before retrieving the plug.

In an embodiment of the invention the drill pipe string conveyed retrievable plug system, the electrical supply (33) comprises a battery (331), preferably arranged together with the control system (3) and retrievable with the drill pipe string after disconnection. In an alternative embodiment the electrical supply (33) comprises connectors to a conductor via a through wired drill pipe string, i.e. the drill pipe string being provided with at least one electrical conductor. Connections and conductors are illustrated in FIG. 3, wherein the embodiment of using a wired pipe drill pipe string is also shown.

In an embodiment of the invention of the drill pipe string conveyed retrievable plug system, said electrical control unit (34) is arranged for receiving a signal (s) from surface to run said motor (45). The signal (s) may comprise adjusting the rotation rate, the "RPM" to e.g. 60 RPM for a duration (d) of e.g. 120 seconds, which should constitute a significant setting preparation signal (s) and which is a rarely occurring RPM signal for other operation. In an embodiment of the invention the signal (s) may also comprise a surface generated pressure pulse signal to confirm. Because the plug is not yet set, one or more weight down or pull on the in order to confirm would not work.

Figure 4:
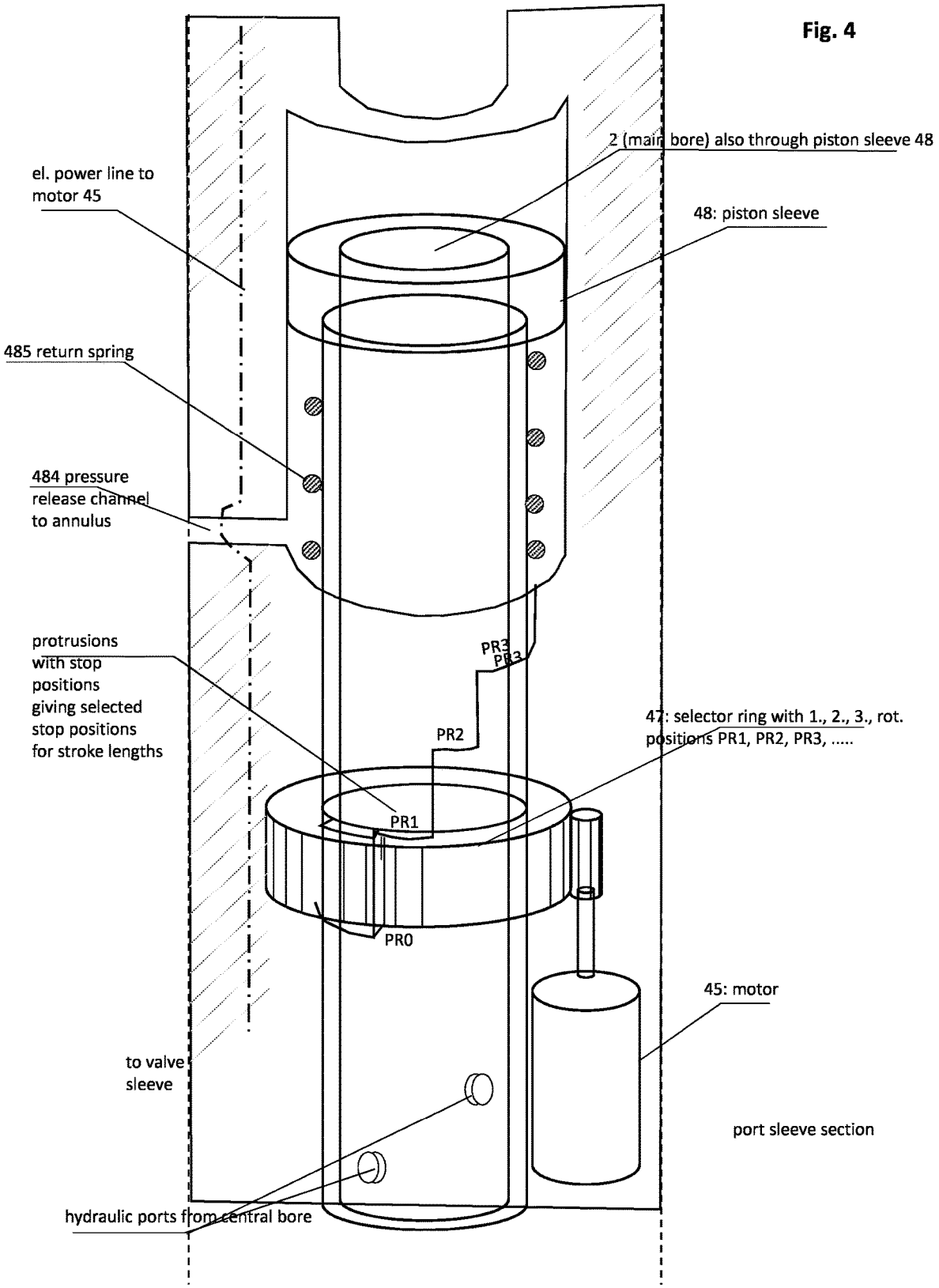
FIG. 4 illustrates the piston sleeve with return spring, the piston sleeve allowed to axially move to different stop positions dependent on a motor-controlled selector ring which may be rotated to a desired angular position.
Figure 5:
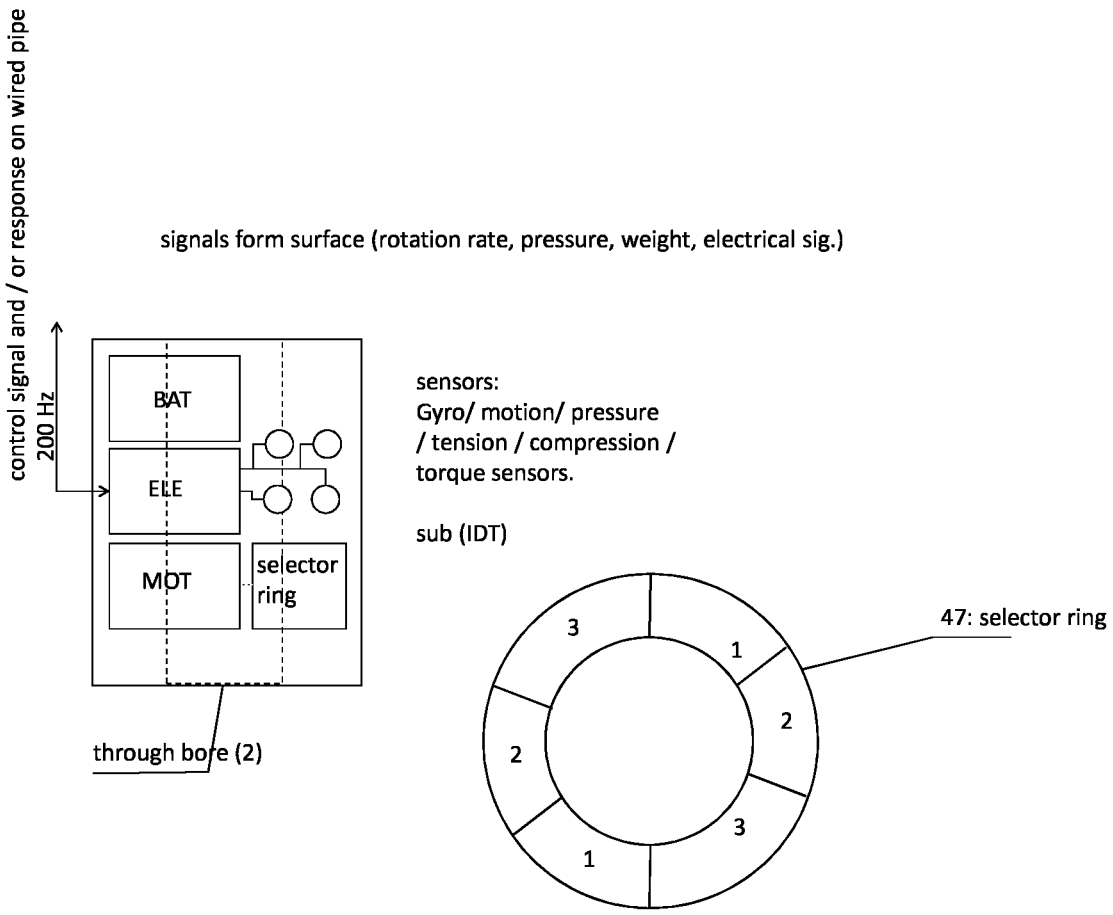
FIG. 5 illustrates in an abstract way the control section controlling a motor further rotating a selector ring which again blocks or allows the piston sleeve to stroke to a predefined stroke length.

In an embodiment of the invention, in the drill pipe string conveyed retrievable plug system, said motor (45) is arranged for to turn a selector ring (47), please see FIG. 4, to a selected first rotational position (PR1) so as for allowing a piston sleeve (48) to slide (here downwardly) to an axial first stop position (PS1) in order for opening to fluid channels (43, 43P, 43S) through said mandrel (41) from said through bore (2) to said packer sleeve (5), please see FIG. 2.

In an embodiment of the invention, said motor (45) is arranged to turn said selector ring (47) to a selected second rotational position (PR2) so as for allowing said piston sleeve (48) to slide to an axial second stop position (PS2) in order for opening to a fluid channel (43B) through said mandrel (41) from said through bore (2) to said ball valve (49).

In FIG. 4, there is an initial rotational position (PR0) of the selector ring (47) which denies any axial movement (PS0) of the piston sleeve (48) at all, which allows the pressure of the drill pipe axial bore (2) not to affect the piston sleeve (48). In FIG. 2 and FIG. 3 we have illustrated that the piston sleeve (48) valve sleeve portion has aligned one of its ports with channels (43*s*) for setting slips (51) or channels (43*p*) for setting packer 52), please see FIG. 2, or for connecting hydraulically to a ball valve actuator piston & cylinder mechanism (492) to close the ball valve (49). It is desirable to release the pressure on the piston sleeve (48) in order to release mechanical load on the selector ring (47) in order to reduce the motor moment (m) required to turn the selector ring (47). In this way, the power and energy required to control the selector ring (47) is far less than the power and energy required to set pressure to move the piston sleeve (48) to the selected depth, and this reduces significantly the power capacity requirements to the motor.

In an embodiment of the invention, a first and second rotational positions (PR1, PR2) are the same, i.e. the slips (51) and packer (52) are set in the same pressure stroke, and a third rotational position (PR3) is required to close the ball valve.

Since the piston stroke chamber under the piston head of the piston sleeve has a pressure release channel (484), and the pressure in the annulus usually is lower than the pressure available in the central bore (2), the pressure gradient creates a force on the piston head even when the ball valve is open. It is a common misunderstanding that the ball valve (49) has to be closed in order to set pressure in the drill pipe string main bore (2), but if there is a circulation in the drill pipe string and return via the annulus, the friction on the fluid in its passage down through the plug and back through the annulus may be sufficient to overcome the spring force of the return spring (485) so as for moving the piston sleeve (48) and for moving the ball valve actuator (492). When the ball valve is closed, it is even easier to increase pressure to further tighten the slips and the packer. With the slips set in the casing wall surrounding the plug, one may also put on weight to increase the force on the slips and packer. Return of the slips and packer when first set may be secured by a ratchet lock mechanism, which is well known in the background art.

In one possible embodiment the plug 1 comprises a control section 3 and a mechanical plug section 4. The control section 3 further comprises an electric supply 33, an electronic control unit 34. The control section 3 contains one or more sensors 36.

In an embodiment of the invention the control section 3 is directly connected to a motor 45 controlled by the electronic control unit 34, please see the middle part of FIG. 1 wherein in one alternative the electronics package is placed below the disconnector, thus being left behind in the well for as long as the plug sits in the well. This embodiment will thus require one control section left down with the plug when set.

In another embodiment of the invention the control section 3 is placed above the disconnector and is indirectly connected to a motor 45 controlled by the electronic control unit 34 of the control section (3), please see the upper part of FIG. 1. This may require electrical connections for power to the motor and possible feedback from proximity sensors across the connector, which must then be "wired".

The electrical supply 33 can be a battery or it can be supplied with electrical power from the surface trough wired drillpipe. One further option for the electrical power supply is that it comprises a mud turbine and generator for generating power downhole, possible in combination with a battery for storing electrical energy. The electrical control unit 34 is supplied with power from the electrical supply 33. One or more sensors 36 can be connected to the electrical control unit 34. Said sensors 36 can be sensors for pressure, torque, weight/tension, temperature and motion (gyro). The electrical control unit 34 is accommodated to receive and act on signals sent from the surface. Signals from surface can be sent as electrical signal in wired drillpipe, by using mud pulse telemetry or by manipulating other physical properties that can be picked up by sensors downhole (torque, weight, tension etc.). In particular rotation rate sensors may continuously measure the rotation rate and determine whether it is at a predefined RPM level for a predefined duration, please see below, in order to activate the system to allow starting setting the slips. The electrical control unit 34 is further connected to an electrical motor 45. The electrical motor 45 can drive an axle with a gear that is accommodated to connect and drive a selector ring 47 in the mechanical plug section 4.

The mechanical plug section 4 comprises a mandrel 41 with a trough bore 2, a ball valve 49 arranged to close said trough bore 2, a packer sleeve 5 with slips 51 and packer element 52, a piston sleeve 48 and the selector ring 47.

The selector ring 47 can be provided with a notch 471, that allows ribs on the piston sleeve 48 to move to a given position, please see FIG. 3. The piston sleeve 48 can slide a distance inside the mandrel 41. A biasing member 485, in an embodiment a return spring 485, acts on the piston sleeve 48 forcing the piston sleeve 48 in the uphole direction where it is limited from further movement. The piston sleeve 48 further comprises a first piston sleeve area 481 exposed to the fluid pressure in the through bore 2 and a second piston sleeve area 482 exposed to the fluid pressure in the annulus A surrounding the plug 1.

When the plug 1 is conveyed to the desired depth in the well a first signal is sent from the surface. The signal is processed by the electric control unit 34 which controls the motor 45. The motor 45 turns the selector ring 47 to a first rotational position PR1. With the selector ring 47 in this position the piston sleeve 48 is allowed to slide to a first stop position PS1 when the biasing force of the return spring or biasing member 485 is overcome. To move the piston sleeve 48 fluid pressure or flow or a combination of the two is established down the drillstring. Due to a pressure gradient on the piston sleeve this results in a greater force on the first piston sleeve area 481 of the piston sleeve 48 compare to the second piston sleeve area 482 of the piston sleeve 48. When the difference in force is high enough the resulting force will overcome the return force biasing force of the return spring 485 and move the piston sleeve 48 in the downhole direction to the first stop position (PS1) or further if so is commanded.

In an embodiment of the invention, as the piston sleeve 48 moves down to the first stop position PS1 it opens an activation channel for setting a piston sleeve to extend and set the slips.

In an embodiment of the invention, one more stop position will open another activation channel to set pressure to set the packer.

A further stop position may be arranged to open to another activation channel to a hydraulic mechanism which closes the ball valve 49. How the ball valve is closed and how the activation channels is exposed can solved in various ways by various embodiments of the plug 1, but some options are illustrated in FIGS. 3 and 4 in combination, wherein different ports in a lower port sleeve section open to different pressure activation channels of the plug, i.e. that the mechanical plug section comprises a activation sleeve that is slidable disposed inside the throughbore 2 covering the activation channel 53. The piston sleeve 48 can comprise a piston sleeve extension extending from the piston sleeve 48 towards the activation sleeve 53, so that when the piston sleeve 48 moves to the first stop position PS1 it pushes on the activation sleeve 8 so the activation sleeve 8 moves and exposes the activation channels 53 in turn.

The activation channels 53 can be coupled to the packer sleeve for hydraulic setting of the slips 51 and packer element 52. It can also be coupled to the ball valve for hydraulic closing of the ball valve 49. Alternatively the ball valve can be closed mechanically by the movement of the activation sleeve. For some applications one may arrange it so that the ball valve 49 will have to close before the slips 51 and packer element 52 can be set, or vice versa. When the ball valve is closed first it is possible to build up pressure inside the drillstring and the through bore 2 and then more force is available for setting of slips 51 and packer element 52. If fluid pressure through a common activation channel 53 is used for both closing the ball valve and for setting the slips and packer it can be design so that the ball valve closes first since that will require the least pressure, and the it possible to increase the pressure after the ball valve is closed.

The slips and packer element can be kept in its extended position by use of a ratchet mechanism or by trapping pressure in the activation channel 53. Trapping the pressure can for instance be done by placing a check valve in the activation channel 53.

The mechanism with the selector ring 47 and the piston sleeve 48 can be used to activate several other functions from surface in combination with the control section 4. Several other rotational positions (PRx) can be defined on the selector ring 47 for defining other stop positions (PSx) for the piston sleeve 48. Each new stop position (PSx) can initiate a new function. Examples of such functions can be release from drillstring, open ball valve 49 and releasing the slips 51 and packer element 52.

When releasing from the drillstring the whole plug 1 can be left downhole or the control section 3 or parts of the control section can be retrieved to surface depending on the embodiment of the plug 1.

For releasing from the drillstring collapsible collet finger can be used together with a J-slot connector. By sending a second signal to the control section the selector ring can be switched to a second rotational position (PR2) which allows the piston sleeve 48 to slide to a second stop position (PS2) where it shifts a sleeve x that allows a set of collet fingers x to collapse and enables for a J-slot release.

Narrower Definition of the Invention

An even more narrow definition of the invention is given as follows: A drill pipe string conveyed retrievable plug system having a central through bore (2)], said plug system comprising:

- a drill pipe string extending from the surface,
- a control section (3); wherein in an embodiment said control section being arranged above a running tool (6),
- the running tool (6) with a connector (61) at a lower end of a drill pipe string with said control section (3),
- a top connector (62) comprising, in an embodiment a top stinger (62) on a mechanical plug section (4) with a bridge plug (1), the top stinger (62) arranged for sitting in the connector (62) provided with a J-slot. (in an embodiment of the invention the J-slot connector (61) is locked by shear pins and releasable upon a given axial force exerted by the drill pipe string)
- said mechanical plug section (4) comprising:
  - a mandrel (41) with said through bore (2, 42),
  - a ball valve (49) arranged for closing said through bore (2),
  - a packer sleeve (5) on said mandrel (41) with slips (51), and
    one or more packer elements (52),
- wherein said control section (3) comprises
- an electric supply (33), with a local battery (331) or conductor through the drill pipe string made up of wired drill pipe sections,
- an electric control unit (34),
- sensors (36) connected to said electric control unit (34), said sensors comprising one or more of rotation sensors, acceleration sensors, axial force sensors, internal or external fluid pressure sensors,
- said mechanical plug section (4) further comprising
- a motor (45) controlled by said electrical control unit (34),
- said motor (45) arranged to turn a selector ring (47) to a selected first rotational position (PR1) so as for allowing a piston sleeve (48) to slide to an axial first stop position (PS1) in order for opening to fluid channels (43, 43P, 43S) through said mandrel (41) from said through bore (2) to said packer sleeve (5).

This will allow setting pressure in said through bore (2) to pressure setting of said packer sleeve (5) in a surrounding casing.

As shown in FIG. 3 we describe the control section (3) being connected to the running tool (6), for arrangement on the drill pipe string such that the control section 3, preferably with battery, is retrieved with the running tool (6) out of the well after disconnection, and the motor for running the selector ring is left with the plug set in the well. This solution requires rather simple mechanics with electrical connections across the connector with J-slot and stinger and that the motor is arranged with the plug's mechanical and motor controlled hydraulic components being left in the hole. An advantage of this arrangement is that one does not have to leave the electronic control unit and the battery downhole while the plug is set for more than a simple intervention operation, and one does not risk discharge of the battery or fluid leakage into the control unit during the time of weeks, months, or even years of parking the plug in the well. Another advantage is that the control section (3) with the electric supply (33) and the electric control unit (34) and sensors (34) may be used for setting other plugs with the same or similar make-up as shown from and including the stinger and down.

In an alternative embodiment the control section (3) may be arranged below the J-slot connector and stinger, as shown in the middle part of FIG. 1. This embodiment leaves the control section (3) fixedly connected with the motor and remainder of the plug downhole when the plug is disconnected after setting. This may be a feasible alternative if the plug shall only remain in the well for a short time such as between a few hours and a week, while other intervention operations are conducted quickly before retrieval of the plug.

The invention is, more specifically, a drill pipe string conveyed retrievable plug system having a central through bore (2), wherein the plug system comprises, generally, from top to bottom, the following main components:

- a drill pipe string for running in the retrievable plug system in a well;
- a control section (3); which in an embodiment is arranged above a running tool (6);
- the running tool (6) with a connector (61) at a lower end of a drill pipe string with said control section (3);
- a top connector (62), in an embodiment said top connector being a top stinger (62), on a mechanical plug section (4) with a bridge plug (1),
- wherein the mechanical plug section (4) comprises a mandrel (41) with said through bore (2, 42), a ball valve (49) arranged for closing said through bore (2, 42), and a packer sleeve (5) on said mandrel (41) with slips (51) and packer element (52),
- and wherein the above mentioned control section (3) comprises an electric supply (33) such as a battery (331) or conductor through wired drill pipe; and an electric control unit (34) connected to sensors (36), and wherein the above mentioned mechanical plug section (4) comprises a motor (45) controlled by said electrical control unit (34), the motor (45) arranged to turn a selector ring (47) to a selected first rotational position (PR1) so as for allowing a piston sleeve (48) to slide to an axial first stop position (PS1) in order for opening to fluid channels (43, 43P, 43S) through said mandrel (41) from said through bore (2) to said packer sleeve (5).

The invention allows activating the control unit (3) through a rotational signal from the surface, so as for allowing setting pressure in said through bore (2) to setting of said packer sleeve (5) in a surrounding casing. When the packer sleeve is set, the ball valve in the plug may be closed, and pressure may be increased to set the packer sleeve even more tightly.

In an embodiment of the invention, said motor (45) is arranged to turn said selector ring (47) to a selected second rotational position (PR2) so as for allowing said piston sleeve (48) to slide to an axial second stop position (PS2) in order for opening from said through bore (2) to a fluid channel (43B) through said mandrel (41) to said ball valve (49). This will allow setting pressure in said through bore (2) to pressure closing of said ball valve (49) in the main bore, or for releasing pressure on said ball valve (49) in the main bore (2) so as for opening said ball valve. The pressure in the main bore (2) may be sufficient to set the slips and packer completely, but one may arrange a ratchet lock mechanism allowing putting weight on the drill pipe string to further tighten the slips and packer before disconnecting. In this way, the present signalling and electronic controlled motor setting of the plug may be used as an initial activation and setting of the plug and the weight down may further tighten the plug if required.

In an embodiment of the drill pipe string conveyed retrievable plug system of the invention, please see FIG. 3, there is arranged an electrical power and/or signal line with connections from said control section (3), through said running tool (6) with said connector (61), preferably with a J-slot connector, through said top connector (62), preferably with said top stinger (62), through said mechanical plug section (4) comprising said mandrel (41), to said motor (45). This allows the control section (3) to connect power and signal to the motor (45) for rotating the selector ring (47). The motor may transfer its rotation moment via its cogwheel to a gear ring of the selector ring (47). When the selector ring is rotated to its intended positon, pressure may be set to move the piston sleeve (48). When pressure is low, the piston's (48) axial force against the selector ring (47) is low, and the selector ring may easily be rotated. When the piston sleeve's (48) protrusions abut against the selector ring, the selector ring may be subject to too high friction to be rotatable.

In an embodiment of the invention, there is arranged an electrical power and/or signal line with connections from said control section (3) to said drill pipe string, said drill pipe string being so-called wired pipe. This allows charging the battery (331) in the control section (3) from surface, or allows power from surface running the motor (45).

(In an embodiment of the invention power to the battery may be provided by a downhole generator; said electric supply (33) may comprises a mud turbine and generator (332) connected to said control section (3).)

In an embodiment of the invention the J-slot connector and the stinger may be initially locked by a set of shear pins, but may in addition have a spline sleeve (621) yielding at a given force so as for allowing compression of said top stinger (62) into said connector (61) comprising the J-slot mechanism (611) of said running tool (6) in order to rotate said running tool and release said top stinger of said bridge plug (1) from the running tool.

This requires ordinary J-slot connector mechanical components, which may further be provided with electrical connectors sealed by seal rings when connected in their operative relative position.

In an embodiment of the invention the drill pipe string conveyed retrievable plug system of the invention may comprise an electrical power and/or signal line with connections from said control section (3) up to said drill pipe string, said drill pipe string being wired.

In an embodiment of the invention said piston sleeve (48) is provided with a return spring (485) with a predefined biasing force. The top area of the piston sleeve is larger than the bottom area. This results in that an initial pressure (pressure difference) on the piston sleeve in order to start sliding to open the fluid channel to set the slips initially.

In an embodiment of the invention, to set the slips and packer and to close said ball valve (49) one may arrange the fluid channels to first pressurize the actuator to set the slips (51), then setting the packer element (52) (they may be actuated with separate piston chambers or have a common piston chambers and slide on the same stem portion of the cylindrical plug mandrel to be set in one common operation), and then closing the ball valve (49). For the opposite operation of opening up and releasing the plug, it is further advantageous to enable opening of the ball valve to control and bleed off pressure below the plug first, then releasing the packer in a controlled manner, and then releasing the slips. Thus it is advantageous to have a separate piston mechanism to close and open the ball valve. This will prevent inadvertent movement of the plug in case of a large pressure gradient across the plug, either in the main bore or in the annulus, because when commanding the opening of the ball valve, one does not risk to release the slips in particular.

In an embodiment of the invention said control section (3) comprises sensors such as one or more of:

a gyro or accelerometer for measuring rotational speed ($\omega$ (RPM), an internal pressure sensor (Pint), an annulus pressure sensor (Pint), a torsion sensor ($\tau$), an axial load "weight" or drill pipe string tension sensor, and a temperature sensor, wherein the sensors provide input to said control section (3) used during initiating and/or controlling said bridge plug (1). As described above the rotational speed and its duration at a stable level may be one initiation criterium for preparing the slips and packer to be set.

In an embodiment of the invention the piston sleeve (48) and/or selector ring (47) is provided with one or more positon or proximity sensors arranged for measuring that said piston sleeve (48) has moved to its intended position or for verifying whether said selector ring (48) has reached its rotational position, i.e. that one or both have entered their commanded position. These sensors may provide signals back to the control section (3) to indicate whether a subsequent step may be taken, e.g. that the slips are set before opening channels to set the packer, or that the packer has been set before trying to close the ball valve, that the slips are engaged before trying to open the ball valve, etc. Setting of the slips to a given axial hold force may be verified independently by exerting a given axial force on the drill pipe string, such as weight down. Closed state of the ball valve may be verified independently from surface by pressuring the central bore. Packer set may be verified independently from surface by testing circulation with open ball valve, or testing annulus pressure integrity.

The invention claimed is:

1. A drill pipe string conveyed retrievable plug system having a central through bore, said plug system comprising:
- a drill pipe string;
- a control section;
- a running tool with a connector at a lower end of said drill pipe string with said control section; and
- a top stinger on a mechanical plug section with a bridge plug section,
- said bridge plug section comprising:
  - a mandrel with said through bore; and
  - a packer sleeve on said mandrel with slips and a packer element,
- said control section comprising:
  - an electrical supply;
  - an electric control unit; and
  - sensors connected to said electric control unit,
- said mechanical plug section further comprising:
  - a motor controlled by said electrical control unit,
- said motor arranged for opening to fluid channels through said mandrel from said through bore to said packer sleeve, so as for allowing setting pressure in said through bore to pressure setting through said fluid channels to said packer sleeve to be engaged in a surrounding casing.

2. The drill pipe string conveyed retrievable plug system of claim 1, comprising a ball valve arranged for closing said through bore.

3. The drill pipe string conveyed retrievable plug system of claim 2, said motor arranged to turn said selector ring to a selected second rotational position so as for allowing said piston sleeve to slide to an axial second stop position-in order for opening to a fluid channel through said mandrel from said through bore to said ball valve.

4. The drill pipe string conveyed retrievable plug system of claim 3, wherein said first and second rotational positions are the same.

5. The drill pipe string conveyed retrievable plug system of claim 1, said electrical supply comprising a battery or conductor from a through wired drill pipe string.

6. The drill pipe string conveyed retrievable plug system of claim 1, said electrical control unit arranged for receiving a signal (s) from surface to run said motor.

7. The drill pipe string conveyed retrievable plug system of claim 1, said signal (s) from surface being a rotation rate signal (s) indicating a predefined drill pipe string rotation rate (w) of a predefined duration (d).

8. The drill pipe string conveyed retrievable plug system of claim 1, said motor arranged for to turn a selector ring to a selected first rotational position so as for allowing a piston sleeve to slide to an axial first stop position in order for opening to said fluid channels through said mandrel from said through bore to said packer sleeve.

9. The drill pipe string conveyed retrievable plug system according to claim 8, wherein said piston sleeve is provided with a return spring with a predefined biasing force.

10. The drill pipe conveyed retrievable plug system of claim 8, wherein said piston sleeve and/or selector ring is provided with one or more positon or proximity sensors arranged for measuring that said piston sleeve has moved to its intended position or for verifying whether said selector ring has reached its rotational position.

11. The drill pipe string conveyed retrievable plug system of claim 1,
- wherein there is arranged an electrical power and/or signal line with connections from said control section,
- through said running tool with said connector, a J-slot connector,
- through said top connector with a stinger for said J-slot connector,
- to said mechanical plug section comprising said mandrel, with to said motor.

12. The drill pipe string conveyed retrievable plug system of claim 1,
- wherein there is arranged an electrical power and/or signal line with connections from said control section to said drill pipe string, said drill pipe string being wired.

13. The drill pipe string conveyed retrievable plug system of claim 1, wherein said electrical supply comprises a local battery arranged in said control section.

14. The drill pipe string conveyed retrievable plug system of claim 1, wherein said electrical supply comprises a transmission line from an outside, topsides electrical source.

15. The drill pipe string conveyed retrievable plug system of claim 1, wherein said electrical supply comprises a mud turbine and generator connected to said control section.

16. The drill pipe string conveyed retrievable plug system of claim 1, wherein said control section comprises sensors such as one or more of a gyro or accelerometer for measuring rotational speed ($\omega$(RPM)), an internal pressure sensor (Pint), an annulus pressure sensor (Pint), a torsion sensor ($\tau$), an axial load or tension sensor, a temperature sensor, said sensors providing input to said control section for used in initiating and controlling said bridge plug.

17. A drill pipe string conveyed retrievable plug system having a central through bore, said plug system comprising:
- a drill pipe string;
- a control section;
- a running tool with a connector at a lower end of said drill pipe string with said control section; and
- a top connector being a top stinger on a mechanical plug section with a bridge plug,
- said mechanical plug section comprising:
  - a mandrel with said through bore;
  - a ball valve arranged for closing said through bore; and
  - a packer sleeve on said mandrel with slips and a packer element,
- said control section comprising:
  - an electric supply;
  - an electric control unit; and
  - sensors connected to said electric control unit,
- said mechanical plug section further comprising:
  - a motor controlled by said electrical control unit,
- said motor arranged to turn a selector ring to a selected first rotational position so as for allowing a piston sleeve to slide to an axial first stop position in order for opening to fluid channels through said mandrel from said through bore to said packer sleeve.

18. The drill pipe string conveyed retrievable plug system of claim 17, wherein said motor is arranged to turn said selector ring to a selected second rotational position so as for allowing said piston sleeve to slide to an axial second stop position in order for opening to a fluid channel through said mandrel from said through bore to said ball valve.

19. A method of plugging a well, comprising the steps of:

providing a drill pipe string conveyed retrievable plug system having a central through bore, and mounting it on a drill pipe string and running it into the well on a running tool with a connector at a lower end of the drill pipe string with said control section, the plug comprising:

a top stinger on a mechanical plug section with a bridge plug section, said bridge plug section comprising:

a mandrel with said through bore; and a packer sleeve on said mandrel with slips and a packer element said control section comprising:

an electrical supply;

an electric control unit; and sensors connected to said electric control unit, said mechanical plug section further comprising:

a motor controlled by said electrical control unit, said motor arranged for controlling a selector ring to control a stroke length of a piston sleeve for opening to fluid channels through said mandrel from said through bore to said packer sleeve;

transmitting a signal from surface to said sensors in said electronic control unit of said control section in order for said motor to control said selector ring to control the stroke length of said piston sleeve so as for allowing setting pressure in said through bore to pressure setting through said fluid channels to said packer sleeve to be engaged in a surrounding casing.

20. The method of claim 19, said signal comprising a constant duration rotational rate over a predefined time period.

21. The method of claim 19, said signal comprising a wired pipe signal.

22. The method of claim 19, said signal comprising a fluid pressure signal in said central bore.

* * * * *